US011633319B2

(12) United States Patent
Huang et al.

(10) Patent No.: US 11,633,319 B2
(45) Date of Patent: Apr. 25, 2023

(54) UNPOWERED WEARABLE WALKING ASSISTANCE KNEE EQUIPMENT WITH GAIT SELF-ADAPTIVITY

(71) Applicant: BEIJING INSTITUTE OF TECHNOLOGY, Haidian District (CN)

(72) Inventors: Qiang Huang, Haidian District (CN); Liancun Zhang, Haidian District (CN); Fei Meng, Haidian District (CN); Weimin Zhang, Haidian District (CN); Zhiheng Wang, Haidian District (CN)

(73) Assignee: Beijing Institute of Technology, Beijing (CN)

( * ) Notice: Subject to any disclaimer, the term of this patent is extended or adjusted under 35 U.S.C. 154(b) by 21 days.

(21) Appl. No.: 16/428,091

(22) Filed: May 31, 2019

(65) Prior Publication Data

US 2019/0282430 A1 Sep. 19, 2019

Related U.S. Application Data

(63) Continuation of application No. PCT/CN2017/071266, filed on Jan. 16, 2017.

(30) Foreign Application Priority Data

Dec. 1, 2016 (CN) ..... 201611092883.9

(51) Int. Cl.
*A61H 3/00* (2006.01)
*A61H 1/02* (2006.01)

(52) U.S. Cl.
CPC ..... *A61H 3/00* (2013.01); *A61H 1/024* (2013.01); *A61H 2003/005* (2013.01);
(Continued)

(58) Field of Classification Search
CPC .... A61H 1/024; A61H 3/00; A61H 2003/005; A61H 2003/007; A61H 2201/1276;
(Continued)

(56) References Cited

U.S. PATENT DOCUMENTS 7,150,722 B1 * 12/2006 Tyrrell ..... A61H 3/008 602/23
2005/0059908 A1 * 3/2005 Bogert ..... A61H 3/00 601/5
(Continued)

FOREIGN PATENT DOCUMENTS

CN 2446976 9/2001
CN 2783953 5/2005
(Continued)

OTHER PUBLICATIONS

International Search Report in corresponding PCT Application No. PCT/CN2017/071266, dated Aug. 18, 2017.

*Primary Examiner* — Timothy A Stanis
(74) *Attorney, Agent, or Firm* — Andrus Intellectual Property Law, LLP

(57) ABSTRACT

The present disclosure discloses an unpowered wearable walking assistance knee equipment with gait self-adaptivity comprising a left foot power output assembly, a right foot power output assembly, a left leg knee joint assistance execution assembly, a right leg knee joint assistance execution assembly and a driving force transmission device. The equipment of the present disclosure is based on lever principle and crank block structure principle and adopts an operation mode of combining ipsilateral parallel driving input and different sides cross driving input. The self-weight of the human body is utilized as a driving force during the walking process to enable the left foot power output assembly to provide the left leg knee joint assistance execution assembly with a pulling force for its stretching and to
(Continued)

provide the right leg knee joint assistance execution assembly with a pulling force for its bending, and to enable the right foot power output assembly to provide the right leg knee joint assistance execution assembly with a pulling force for its stretching and to provide the left leg knee joint assistance execution assembly with a pulling force for its bending, so that a torque for assisting the stretching and bending of the left leg knee joint and the right leg knee joint is generated according to a gait cycle regularity during the walking process, and the goal of walking assistance is achieved.

9 Claims, 7 Drawing Sheets

(52) U.S. Cl.
CPC ..... *A61H 2003/007* (2013.01); *A61H 2201/1276* (2013.01); *A61H 2201/14* (2013.01); *A61H 2201/1642* (2013.01); *A61H 2201/1652* (2013.01)

(58) Field of Classification Search
CPC ..... A61H 2201/14; A61H 2201/1642; A61H 2201/1652
See application file for complete search history.

(56) References Cited

U.S. PATENT DOCUMENTS

| | | | | |
|---|---|---|---|---|
| 2009/0107533 | A1* | 4/2009 | Nativ | A61H 3/04 135/67 |
| 2014/0190289 | A1* | 7/2014 | Zhu | B25J 9/104 74/89.22 |
| 2016/0038313 | A1* | 2/2016 | Kim | A61F 2/70 623/24 |
| 2016/0128890 | A1* | 5/2016 | LaChappelle | A61F 2/70 623/30 |

FOREIGN PATENT DOCUMENTS

| | | |
|---|---|---|
| CN | 204121372 | 1/2015 |
| CN | 104552276 | 4/2015 |
| CN | 105500343 | 4/2016 |
| CN | 105943314 | 9/2016 |
| CN | 106029039 | 10/2016 |
| JP | 2012100983 | 11/2013 |
| KR | 1020120082219 | 7/2012 |
| WO | WO 2014127386 | 8/2014 |

* cited by examiner

UNPOWERED WEARABLE WALKING ASSISTANCE KNEE EQUIPMENT WITH GAIT SELF-ADAPTIVITY

CROSS-REFERENCE TO RELATED PATENT APPLICATIONS

The present application is a continuation of International Application No. PCT/CN2017/071266, filed Jan. 16, 2017, which claims the benefit of priority to Chinese Application No. CN 201611092883.9, filed on Dec. 1, 2016, the content of which is incorporated herein by reference in its entirety.

FIELD OF THE INVENTION

The present disclosure belongs to the field of knee joint auxiliary instrument and walking assistance equipment, and especially to an unpowered wearable walking assistance knee equipment with gait self-adaptivity.

BACKGROUND

The muscle strength and joint function of the elderly will gradually decline with age and this is most obvious in the respect of lower extremity strength attenuation and lower extremity joint injuries, which affects the ability to move and quality of life of the elderly. Young and middle-aged population may also suffer from strains in their knee joints, such as meniscus injuries, during long-term exercise or work. In addition, minor stroke patients also have partial disability in motor ability of lower extremity, affecting the patient's ability to move. Proper and appropriate walking aid exercise for lower extremity joints can help the elderly and the patient with partial disability in lower extremity to improve their muscle vitalities and enhance their self-care abilities and health status. With the aim of improving and enhancing walking ability of the elderly who suffer from decreased motor ability, young and middle-aged people with sports injuries in leg joints and patients with brain diseases such as stroke that have partial disability in lower extremity, the walking assistance mechanism is required to be small, light-weight, simple and practical and high comfort.

At present, mature walking aid products mainly include: crutches, walking aids, and non-powered wheelchairs. Although these walking aid products can have the function of helping the elderly or patients with partial disability in lower extremity to maintain the balance of movement or can be used as transports to move, they need the aid of upper limb strength duo to lacking power, which will make people feel laborious when walking. In addition, exoskeleton robots relating to hip joint walking assistance and exoskeleton robots relating to knee joint walking assistance are also current hot topics in the study of walking assistance. However, they have larger volumes and weights, and the rigid mechanisms thereof have a large inertia which causes a poor comfort and have not yet been practically applied to daily walking of the elderly and the patients with sports injuries in lower extremity joints or partial disability in lower extremity.

SUMMARY OF THE INVENTION

The purpose of the present disclosure is to provide an unpowered wearable walking assistance knee equipment with gait self-adaptivity in view of the above-mentioned drawbacks of the above prior art. The execution assemblies of the unpowered wearable walking assistance knee equipment with gait self-adaptivity act on the knee joints of the lower extremities and use the self-weight of the human body as a driving force without the need of other external power and energy input. The equipment is based on lever principle and crank block structure principle and adopts an operation mode of combining ipsilateral parallel driving input and different sides cross driving input performed on a left leg knee joint assistance execution assembly and a right leg knee joint assistance execution assembly by a left foot power output assembly and a right foot power output assembly. During the walking process, by utilizing the self-weight of the human body and by using Bowden cables as a medium for transmitting the driving force, the left foot power output assembly provides the left leg knee joint assistance execution assembly with a pulling force for its stretching and provides the right leg knee joint assistance execution assembly with a pulling force for its bending, and the right foot power output assembly provides the right leg knee joint assistance execution assembly with a pulling force for its stretching and provides the left leg knee joint assistance execution assembly with a pulling force for its bending so that a torque for assisting the stretching and bending of the left leg knee joint and the right leg knee joint is generated according to a gait cycle rhythm and adaptive to the gait during the walking process, and the goal of walking assistance is achieved.

In order to achieve the above object, the technical solution adopted by the present disclosure is:

An unpowered wearable walking assistance knee equipment with gait self-adaptivity, comprises:

a left leg knee joint assistance execution assembly adapted to be fixed at a position corresponding to the left leg keen joint for providing the left leg knee joint with a torque for assisting its stretching and bending during a walking process;

a right leg knee joint assistance execution assembly adapted to be fixed at a position corresponding to the right leg keen joint for providing the right leg knee joint with a torque for assisting its stretching and bending during the walking process;

left foot power output assembly adapted to be worn on a user's left foot and capable of providing the left leg knee joint assistance execution assembly with a power for its stretching and providing the right leg knee joint assistance execution assembly with a power for its bending;

a right foot power output assembly adapted to be worn on a user's right foot and capable of providing the right leg knee joint assistance execution assembly with a power for its stretching and providing the left leg knee joint assistance execution assembly with a power for its bending; and a driving force transmission device capable of transmitting the power provided by the left foot power output assembly and the right foot power output assembly to the left leg knee joint assistance execution assembly and the right leg knee joint assistance execution assembly.

In one embodiment, the driving force transmission device comprises:

a first Bowden cable and a first Bowden cable sleeve, one end of which being connected with the left foot power output assembly and the other end of which being connected with a stretching power input of the left leg knee joint assistance execution assembly for enabling the left foot power output assembly to provide the left leg knee joint assistance execution assembly with a pulling force for its stretching;

a second Bowden cable and a second Bowden cable sleeve, one end of which being connected with the left foot power output assembly and the other end of which being connected with a bending power input of the right leg knee joint assistance execution assembly for enabling the left foot power output assembly to provide the right leg knee joint assistance execution assembly with a pulling force for its bending;

a third Bowden cable and a third Bowden cable sleeve, one end of which being connected with the right foot power output assembly and the other end of which being connected with a bending power input of the left leg knee joint assistance execution assembly for enabling the right foot power output assembly to provide the left leg knee joint assistance execution assembly with a pulling force for its bending; and a fourth Bowden cable and a fourth Bowden cable sleeve, one end of which being connected with the right foot power output assembly and the other end of which being connected with a stretching power input of the right leg knee joint assistance execution assembly for enabling the right foot power output assembly to provide the right leg knee joint assistance execution assembly with a pulling force for its stretching.

In one embodiment, the left foot power output assembly comprises: a first base plate, a first active plate, a first Bowden cable sleeve fixation bracket, a first hinge and a first rotation shaft; a front end of the first base plate and a front end of the first active plate form a lever structure with the first rotation shaft as a fulcrum; a rear end of the first base plate is connected with one end of the first Bowden cable and one end of the second Bowden cable, and a rear end of the first active plate is connected with one end of the first Bowden cable sleeve and one end of the second Bowden cable sleeve.

The right foot power output assembly comprises: a second base plate, a second active plate, a second Bowden cable sleeve fixation bracket, a second hinge and a second rotation shaft; a front end of the second base plate and a front end of the second active plate form a lever structure with the second rotation shaft as a fulcrum; a rear end of the second base plate is connected with one end of the third Bowden cable and one end of the fourth Bowden cable and a rear end of the second active plate is connected with one end of the third Bowden cable sleeve and one end of the fourth Bowden cable sleeve.

In one embodiment, the left foot power output assembly and the right foot power output assembly each also comprises: a rubber pad, a rubber buffer fiction pad, a rubber anti-slip pad and an elastic fixation band.

In one embodiment, the first base plate and the second base plate are made of hard aluminum alloy material, and the first active plate and the second active plate are made of carbon fiber material.

In one embodiment, the left leg knee joint assistance execution assembly comprises: a left thigh fixation plate, a left shank fixation plate, a first guide, a first slider, a first link and a first tension spring. The left thigh fixation plate, the left shank fixation plate, the first link, the first guide and the first slider constitute a crank block structure and form two revolute pairs. A pulling force provided to the first slider by the first Bowden cable is converted to a clockwise rotation of the left shank fixation plate relative to the left thigh fixation plate through the first link to provide the left shank with a torque for assisting the stretching of the left leg knee joint. The third Bowden cable provides a pulling force to the first slider through the first tension spring and the pulling force is converted to a counterclockwise rotation of the left shank fixation plate relative to the left thigh fixation plate through the first link to provide the left shank with a torque for assisting the bending of the left leg knee joint.

The right leg knee joint assistance execution assembly comprises: a right thigh fixation plate, a right shank fixation plate, a second guide, a second slider, a second link and a second tension spring. The right thigh fixation plate, the right shank fixation plate, the second link, the second guide and the second slider constitutes a crank block structure and form two revolute pairs. A pulling force provided to the second slider by the second Bowden cable is converted to a clockwise rotation of the right shank fixation plate relative to the right thigh fixation plate through the second link to provide the right shank with a torque for assisting the bending of the right leg knee joint. The fourth Bowden cable provides a pulling force to the second slider through the second tension spring and the pulling force is converted to a counterclockwise rotation of the right shank fixation plate relative to the right thigh fixation plate through the second link to provide the right shank with a torque for assisting the stretching of the right leg knee joint.

In one embodiment, the left leg knee joint assistance execution assembly and the right leg knee joint assistance execution assembly each also comprises a protection cover and a flexible fixation band.

In one embodiment, the left shank fixation plate can be rotated relative to the left thigh fixation plate at an angle in a range of 30° to 200° in the left leg knee joint assistance assembly and the right shank fixation plate can be rotated relative to the right thigh fixation plate at an angle in a range of 30° to 200° in the right leg knee joint assistance assembly.

In one embodiment, the left shank fixation plate can be rotated relative to the left thigh fixation plate at an angle in a range of 120° to 180° in the left leg knee joint assistance assembly and the right shank fixation plate can be rotated relative to the right thigh fixation plate at an angle in a range of 120° to 180° in the right leg knee joint assistance assembly.

In one embodiment, the left thigh fixation plate, the left shank fixation plate, the right thigh fixation plate and the right shank fixation plate are made of high carbon fiber material, aluminum-magnesium alloy or hard aluminum alloy material.

The beneficial effects of the present disclosure are:

1. Compared with the prior art, the unpowered wearable walking assistance knee equipment with gait self-adaptivity of the present disclosure has the feature of requiring no external power and energy input. The equipment uses the self-weight of a human body as the driving force for the equipment, and no external energy sources in form of, e.g., electric current and air pump are required, which eliminates dependency of the current general walking assistance equipment such as the exoskeleton robots on external energy sources and directly reduces the volume and mass of the equipment so as to make the equipment more portable.

2. Compared with the prior art, the equipment adopts the operation mode of combining ipsilateral parallel driving input and different sides cross driving input performed on the left leg knee joint assistance execution assembly and the right leg knee joint assistance execution assembly by the left foot power output assembly and the right foot power output assembly. during the walking process, by utilizing the self-weight of the human body and by using the Bowden cables as a medium for transmitting the driving force, the left foot power output assembly provides the left leg knee joint assistance execution assembly with a pulling force for its stretching and provides the right leg knee joint assistance execution assembly with a pulling force for its bending, and the right foot power output assembly provides the right leg knee joint assistance execution assembly with a pulling force for its stretching and provides the left leg knee joint assistance execution assembly with a pulling force for its bending, so that a torque for assisting the bending and stretching of the left leg knee joint and the right leg knee joint is generated according to a gait cycle regularity during the walking process, and the goal of walking assistance is achieved. The left leg knee joint assistance execution assembly and the right leg knee joint assistance execution assembly use the tension spring as an energy storage and buffer to reduce the mechanical inertia of the execution assembly.

Thus, the present disclosure uses the self-weight of a human body as the driving force for the equipment and requires no other external power and energy input, and has small volume, light-weight, and good portability. In addition, the equipment of the present disclosure has a small inertia and good comfort, and can not only achieve the aim of assisting the population with decreased motor ability in lower extremity, the patients with sports injuries in lower extremity joints and the patients with partial disability in lower extremity to walk, but also can help the elderly, the patients with sports injuries in lower extremity joints and the patients with partial disability in lower extremity to improve their muscle vitality so as to improve their self-care abilities and health status.

The meanings of the reference signs are as below:

1: left foot power output assembly, 2: right foot power output assembly, 3: left leg knee joint assistance execution assembly, 4: right leg knee joint assistance execution assembly, 5: Bowden cable assembly.

101: base plate, 102: active plate, 103: Bowden cable sleeve fixation bracket, 104: hinge, 105: rotation shaft, 106: rubber pad, 107: Rubber buffer friction pad, 108: rubber anti-slip pad. 109: Bowden cable, 110: Bowden cable sleeve, 111: Bowden cable, 112: Bowden cable sleeve, 113: elastic fixation band.

201: base board, 202: activity board, 203: Bowden cable sleeve fixation bracket, 204: hinge, 205: rotation shaft, 206: rubber pad, 207: rubber buffer friction pad, 208: rubber anti-slip pad, 209: Bowden cable, 210: Bowden cable sleeve, 211: Bowden cable, 212: Bowden cable sleeve, 213: elastic fixation band.

301: left thigh fixation plate, 302: left shank fixation plate, 303: protection cover, 304: flexible fixation band, 305: rotation shaft, 306: guide, 307: slider, 308: link, 309: Bowden cable fixation connector, 310: Bowden cable sleeve fixation base, 311: tension spring, 312: Bowden cable sleeve connection fixator, 313: fastener, 314: rivet.

401: right thigh fixation plate, 402: right shank fixation plate, 403: protection cover, 404: flexible fixation band, 405: rotation shaft, 406: guide, 407: slider, 408: link, 409: Bowden cable fixation connector, 410: Bowden cable sleeve fixation base, 411: tension spring, 412: Bowden cable sleeve connection fixator, 413: fastener, 414: rivet.

PREFERRED EMBODIMENTS OF THE PRESENT INVENTION

The present disclosure will be further described below with reference to the accompanying drawings and specific embodiments, but it is not intended to limit the present disclosure.

Figure 1:
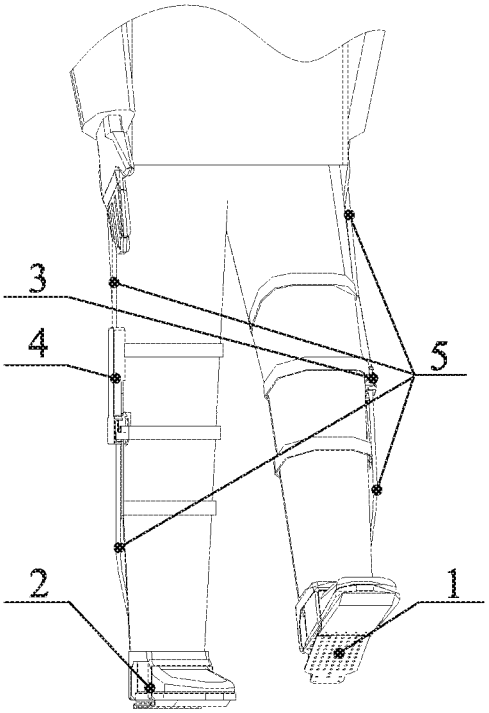
FIG. 1 is a diagram showing main constitution of the unpowered wearable walking assistance knee equipment with gait self-adaptivity according to the present disclosure.

As shown in FIG. 1, an unpowered wearable walking assistance knee equipment with gait self-adaptivity uses the self-weight of a human body as a driving force and requires no other external power and energy input. The equipment is mainly constituted of a left foot power output assembly 1, a right foot power output assembly 2, a left leg knee joint assistance execution assembly 3, a right leg knee joint assistance execution assembly 4 and a Bowden cable assembly 5. The left foot power output assembly 1 and the right foot power output assembly 2 are worn on the left foot and the right foot respectively and are the power sources of the unpowered wearable walking assistance knee equipment for providing power to the left leg knee joint assistance execution assembly 3 and the right leg knee joint assistance execution assembly 4. The left leg knee joint assistance execution assembly 3 and the right leg knee joint assistance execution assembly 4 are fixed at the positions corresponding to the left leg knee joint and the right leg knee joint respectively and are execution assemblies of the unpowered wearable walking assistance knee equipment for providing the left leg joint and the right leg joint with a torque for assisting their stretching and bending according to a gait cycle regularity during the walking process. The Bowden cable assembly 5 comprises four Bowden cables and four Bowden cable sleeves used in pairs which are the transmitting medium and displacement passage for the driving force (pulling force) respectively. The Bowden cables in the Bowden cable assembly 5 are used to transmit the pulling force between the left foot power output assembly 1 and the left leg knee joint assistance execution assembly 3, the pulling force between the left foot power output assembly 1 and the right leg knee joint assistance execution assembly 4, the pulling force between the right foot power output assembly 2 and the left leg knee joint assistance execution assembly 3 and the pulling force between right foot power output assembly 2 and the right leg knee joint assistance execution assembly 4. During the walking process, by utilizing the self-weight of the human body and by using the Bowden cables in the Bowden cable assembly 5 as a medium for transmitting the driving force, the left foot power output assembly 1 provides the left leg knee joint assistance execution assembly 3 with a pulling force for its stretching and provides the right leg knee joint assistance execution assembly 4 with a pulling force for its bending, and the right foot power output assembly 2 provides the right leg knee joint assistance execution assembly 4 with a pulling force for its stretching and provides the left leg knee joint assistance execution assembly 3 with a pulling force for its bending, so that a torque for assisting the bending and stretching of the left leg knee joint and the right leg knee joint is generated according to a gait cycle regularity during the walking process, and the goal of walking assistance is achieved.

Figure 2:
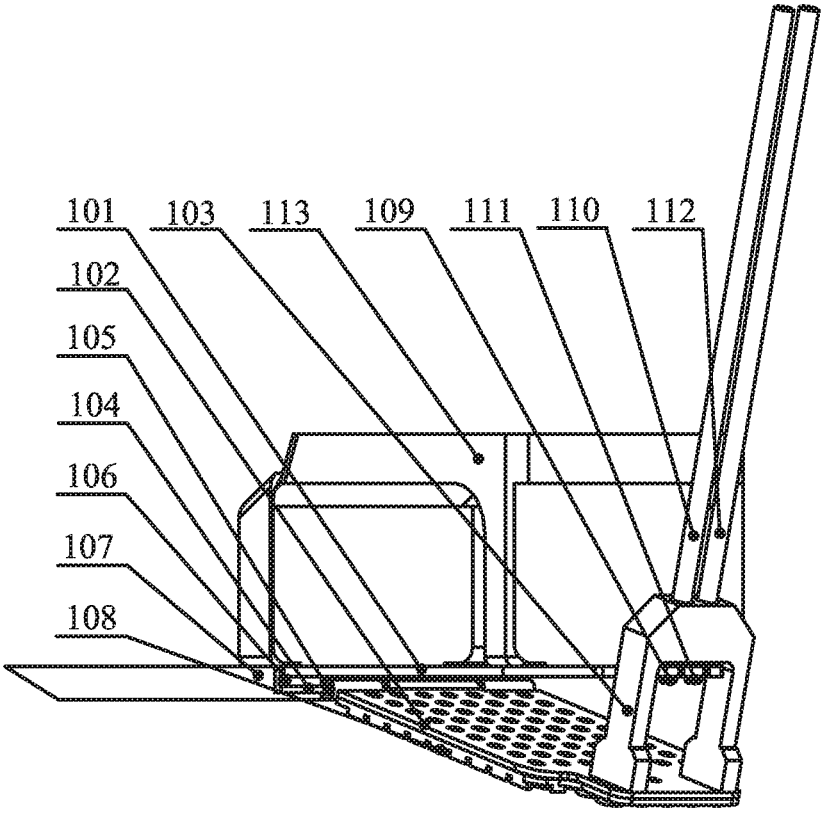
FIG. 2 is a working condition diagram showing the constitution of the left foot power output assembly without the effect of the self-weight of a human body according to the present disclosure.

FIG. 2 is a working condition diagram showing the constitution of the left foot power output assembly 1 without the effect of the self-weight of a human body according to the present disclosure. The left foot power output assembly 1 comprises a base plate 101, an active plate 102, a Bowden cable sleeve fixation bracket 103, a hinge 104, a rotation shaft 105, a rubber pad 106, a rubber buffer friction pad 107, a rubber anti-slip pad 108, a Bowden cable 109, a Bowden cable sleeve 110, a Bowden cable 111, a Bowden cable sleeve 112 and an elastic fixation band 113, etc. The base plate 1 is made of high hard aluminum alloy material with higher rigidity and goes through the process of partial reinforcement and integral weight reduction to have the function of integral fixation and support. The active plate 102 is made of high strength carbon fiber material and is another import fixation and support part of the left foot power output assembly 1. The active plate 102 and the hinge 104 are hinged by the rotation shaft 105 and the active plate 102 can be rotated about the hinge 104 at angle in a certain range. The hinge 104 is fixed on the base plate 101 with a rubber pad 106 therebetween for vibrational isolation. The rubber buffer fiction pad 107 is fixed on the outside of the hinge 104 and, together with the rubber anti-slip pad 108 adhered to the bottom surface of the active plate 102, has the function of buffering and anti-slip during the walking process.

The Bowden cable 109 and the Bowden cable 111 use 65Mn material with higher elasticity and toughness and are the medium for transmitting the pulling force between the left foot power output assembly 1 and the left leg knee joint assistance execution assembly 3 and the medium for transmitting the pulling force between the left foot power output assembly 1 and the right leg knee joint assistance execution assembly 4. The Bowden cable sleeve 110 and the Bowden cable sleeve 112 are displacement passages and protection sleeves for the Bowden cable 109 and the Bowden cable 111 respectively. The Bowden cable sleeve fixation bracket 103 uses high hard aluminum alloy material with higher rigidity and is fixed on the active plate 102 through a screw fastener, which is mainly for fixing the Bowden cable sleeve 110 and the Bowden cable sleeve 112 and for providing a displacement space for vertical reciprocating movement of the active plate 102, the Bowden cable 109 and the Bowden cable 111. One end of the Bowden cable sleeve 110 is fastened in a left spacing hole of the Bowden cable sleeve fixation bracket 103 and the other end of the Bowden cable sleeve 110 is fixed to the Bowden cable sleeve connection fixator 312 in the left leg knee joint assistance execution assembly 3. One end of the Bowden cable 109 is fixed in a left clamping opening of the base late 101 through the Bowden cable sleeve 110 and the other end of the Bowden cable 109 is fixed to the slider 307 in the left leg knee joint assistance execution assembly 3 through the Bowden cable fixation connector 309 for providing a pulling force to the slider 307. One end of the Bowden cable sleeve 112 is fastened in a right spacing hole of the Bowden cable sleeve connection fixation bracket 103 and the other end of the Bowden cable sleeve 112 is fixed to the Bowden cable sleeve fixation base 410 in the right leg knee joint assistance execution assembly 4. One end of the Bowden cable 111 is fixed in a right clamping opening of the base late 101 through the Bowden cable sleeve 112 and the other end of the Bowden cable 111 is fixed to the tension spring 411 in the right leg knee joint assistance execution assembly 4 through the Bowden cable sleeve 112 for providing a pulling force to the tension spring 411. The elastic fixation band 113 is made of nylon material with better flexibility and is fixed on the base plate 101 through the rivet for fixing the shoe with the left foot power output assembly 1 when using the unpowered wearable walking assistance knee equipment.

The base plate 101 and the active plate 102 form a lever structure with the rotation shaft 105 as a fulcrum. The distance from the weight effect point of the self-weight of the human body on the base plate 101 to the fulcrum is a power arm of the lever, and the distance from the effect point of the joint force from the Bowden cable 109 in the left clamping opening of the base plate 101 and the Bowden cable 111 in the right clamping opening of the base plate 101 to the fulcrum is a resisting arm of the lever. The left foot power output assembly 1 is based on such lever structure and provides a power to the left leg knee joint assistance execution assembly 3 and the right leg knee joint assistance execution assembly 4 of the unpowered wearable walking assistance knee equipment respectively by using the self-weight of the human body.

Figure 3:
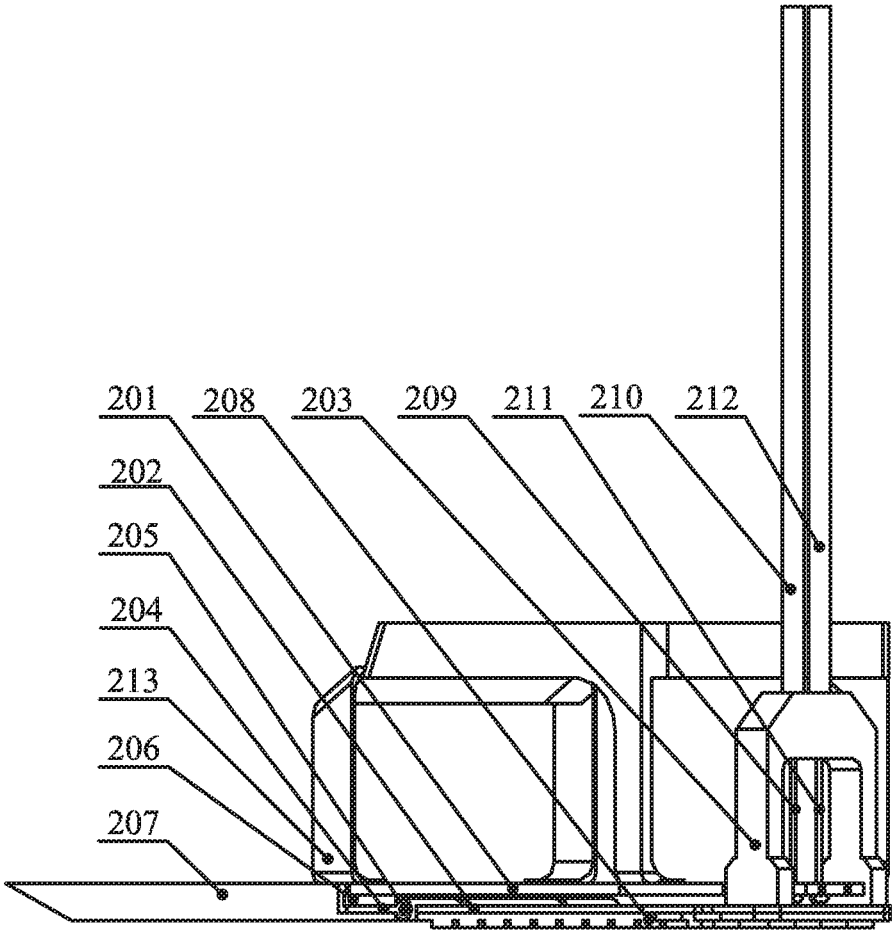
FIG. 3 is a working condition diagram showing the constitution of the right foot power output assembly with the effect of the self-weight of a human body according to the present disclosure.

FIG. 3 is a working condition diagram showing the constitution of the right foot power output assembly with the effect of the self-weight of a human body according to the present disclosure. The right foot power output assembly 2 has the same structure as that of the left foot power output assembly 1 and comprises: a base plate 201, an active plate 202, a Bowden cable sleeve fixation bracket 203, a hinge 204, a rotation shaft 205, a rubber pad 206, a rubber buffer friction pad 207, a rubber anti-slip pad 208, a Bowden cable 209, a Bowden cable sleeve 210, a Bowden cable 211, a Bowden cable sleeve 212 and an elastic fixation band 213, etc. The constitution, material of the parts, the form of the structure and the way of mounting are the same as those of the left foot power output assembly 1 and the same portion of the both will not be explored here.

The Bowden cable 209 and the Bowden cable 211 are the medium for transmitting the pulling force between the right foot power output assembly 2 and the left leg knee joint assistance execution assembly 3 and the medium for transmitting the pulling force between the right foot power output assembly 2 and the right leg knee joint assistance execution assembly 4 respectively. The Bowden cable sleeve 210 and the Bowden cable sleeve 212 are displacement passages and protection sleeves for the Bowden cable 209 and the Bowden cable 211 respectively. The Bowden cable sleeve fixation bracket 203 is fixed on the active plate 202 through a screw fastener, which is for fixing the Bowden cable sleeve 210 and the Bowden cable sleeve 212 and for providing a displacement space for vertical reciprocating movement of the active plate 202, the Bowden cable 209 and the Bowden cable 211. One end of the Bowden cable sleeve 210 is fastened in a left spacing hole of the Bowden cable sleeve fixation bracket 203 and the other end of the Bowden cable sleeve 210 is fixed to the Bowden cable sleeve fixation base 310 in the left leg knee joint assistance execution assembly 3. The Bowden cable 209 goes through the Bowden cable sleeve, one end of the Bowden cable 209 is fixed in a left clamping opening at the end of the base late 201 and the other end of the Bowden cable 209 is fixed to the tension spring 311 in the left leg knee joint assistance execution assembly 3 for providing a pulling force to the tension spring 311 and the slider 307. One end of the Bowden cable sleeve 212 is fastened in a right spacing hole of the Bowden cable sleeve fixation bracket 203 and the other end of the Bowden cable sleeve 212 is fixed to the Bowden cable sleeve connection fixator 412 in the right leg knee joint assistance execution assembly 4. The Bowden cable 211 goes through the Bowden cable sleeve 212, one end of the Bowden cable 211 is fixed in a right clamping opening at the end of the base late 101 and the other end of the Bowden cable 211 is fixed to the slider 407 in the right leg knee joint assistance execution assembly 4 through the Bowden cable fixation connector 409 for providing a pulling force to the slider 407.

The base plate 201 and the active plate 202 form a lever structure with the rotation shaft 205 as a fulcrum. The distance from the weight effect point of the self-weight of the human body on the base plate 201 to the fulcrum is a power arm of the lever, and the distance from the effect point of the joint force from the Bowden cable 209 in the left clamping opening at the end of the base plate 201 and the Bowden cable 211 in the right clamping opening at the end of the base plate 201 to the fulcrum is a resisting arm of the lever. The right foot power output assembly 2 is based on such lever structure and provides a power to the left leg knee joint assistance execution assembly 3 and the right leg knee joint assistance execution assembly 4 of the unpowered wearable walking assistance knee equipment respectively by using the self-weight of the human body.

FIGS. 2 and 3 also show two extreme states of the left foot power output assembly 1 and the right foot power output assembly 2. FIG. 2 shows a state where the left foot power output assembly 1 does not bear the self-weight of the human body, i.e., the state where the foot is lifted up off the ground during the process of stepping, the self-weight of the human body does not act on the lever structure formed by the base plate 101 and the active plate 102, and the pulling force output to the Bowden cable 109 and the Bowden cable 111 is minimal at this time. While FIG. 3 shows a state where the right foot power output assembly 2 bears the weight of the human body to the most extent, i.e., the state where the self-weight of the human body fully act on the base plate 201 of the right foot power output assembly 2 during the process of stepping. At this time, the base plate 201 and the active plate 202 form the lever structure with the rotation shaft 205 as the fulcrum. The distance from the weight effect point of the self-weight of the human body on the base plate 201 to the fulcrum is the power arm of the lever, and the distance from the effect point of the joint force from the Bowden cable 209 in the left clamping opening of the base plate 201 and the Bowden cable 211 in the right clamping opening of the base plate 201 to the fulcrum is the resisting arm of the lever. Based on this lever structure, the right foot power output assembly 2 relies on the self-weight of the human body to provide a pilling force to the Bowden cable 209 and the Bowden cable 210 and the pulling force provided in this state reaches a maximum.

Figure 4:
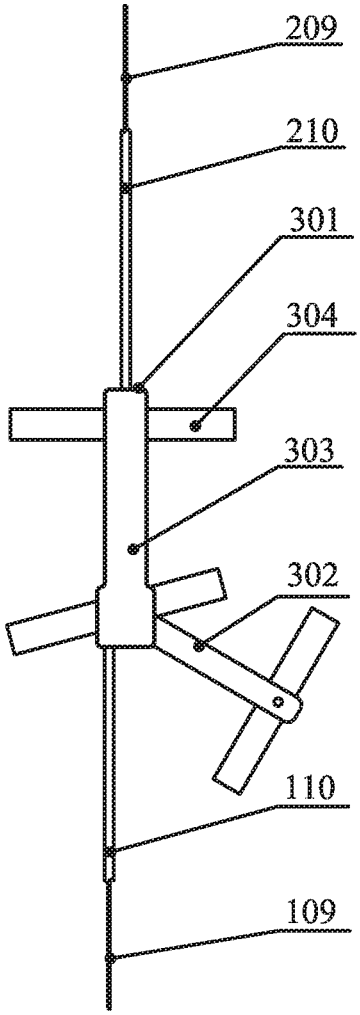
FIG. 4 is an outline diagram showing the constitution of the left leg knee joint assistance execution assembly according to the present disclosure.
Figure 5:
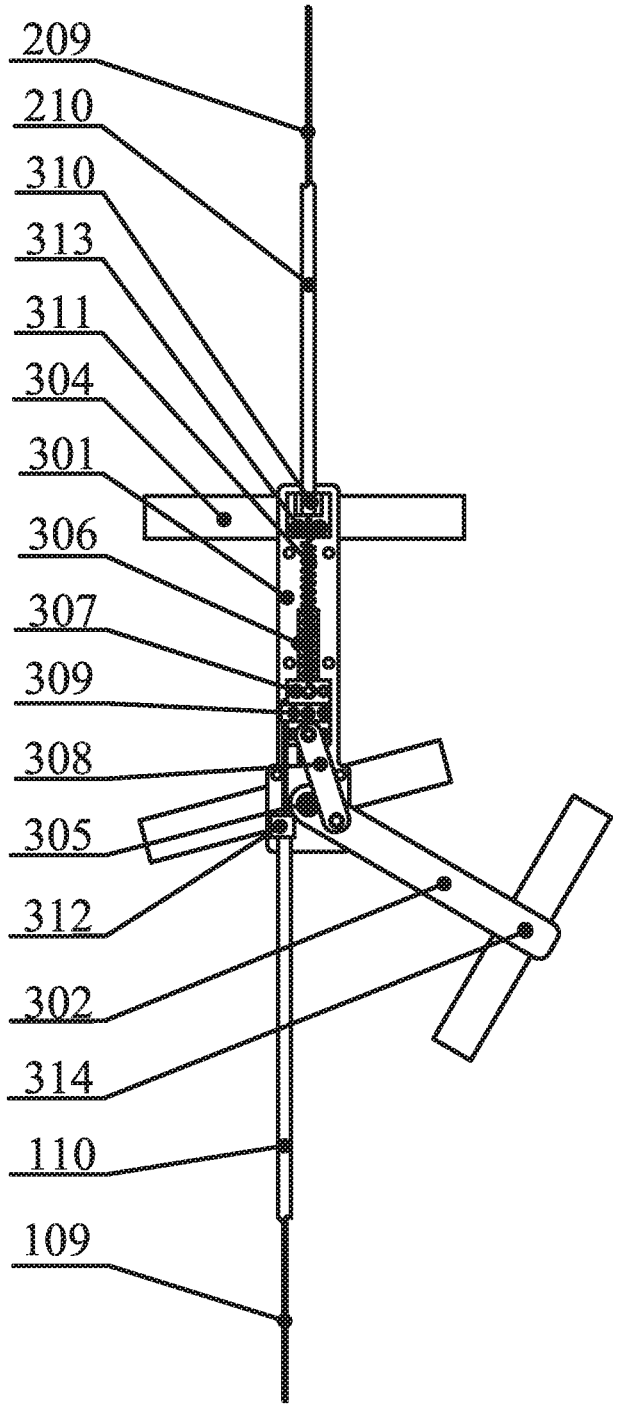
FIG. 5 is a diagram showing the main constitution and internal assembly relationship of the left leg knee joint assistance execution assembly according to the present disclosure.

FIG. 4 is an outline diagram of the left leg knee joint assistance execution assembly 3 and FIG. 5 is a diagram showing the main constitution and internal assembly relationship of the left leg knee joint assistance execution assembly 3. As shown in FIGS. 4 and 5, the left leg knee joint assistance execution assembly 3 is mainly constituted with a left thigh fixation plate 301, a left shank fixation plate 302, a protection cover 303, a flexible fixation band 304, a rotation shaft 305, a guide 306, a slider 307, a link 308, a Bowden cable fixation connector 309, a Bowden cable sleeve fixation base 310, a tension spring 311, a Bowden cable sleeve connection fixator 312, a fastener 313, a rivet 314, the Bowden cable 109, the Bowden cable sleeve 110, the Bowden cable 209 and the Bowden cable sleeve 210.

The left leg knee joint assistance execution assembly 3 is fixed at a position corresponding to the left leg knee joint through the flexible fixation band 304. The left thigh fixation plate 301 and the left shank fixation plate 302 are made of light-weight and high-strength carbon fiber material and have the function of transmitting force and supporting. The protection cover 303 is a sealed protection casing for internal parts of the left leg knee joint assistance execution assembly 3 to prevent the internal parts from being damaged and invalided due to the effect of external force. The flexible fixation band 304 is made of self-adhesive cloth and elastic belt with better flexibility and is fixed on the left thigh fixation plate 301 and the left shank fixation plate 302 through the rivet.

As shown in FIG. 5, the left shank fixation plate 302 is mounted on the rotation shaft 305 of the left thigh fixation plate 301 and can be rotated about the rotation shaft 305 at an angle in a design angle range. The guide 306 and the Bowden cable sleeve fixation base 310 are fixed on the left thigh fixation plate 301 through the fastener 313, and the slider 307 is mounted on the guide 306 and can do linear reciprocating motion within the rated travel of the guide. One end of the tension spring 311 is fixed to the slider 307 and the other end of the tension spring 311 is fixed to the Bowden cable 209 to be used as an energy storage unit. The Bowden cable sleeve connection fixator 312 is fixed in a mounting hole on the left side of the bottom of the left thigh fixation plate 301 through a screw fastener for fixing the Bowden cable sleeve 110 and also has the function of limiting the clockwise rotation angle extreme position of the left shank fixation plate 302. The Bowden cable 109 goes through the Bowden cable sleeve 110, one end of the Bowden cable 109 is fixed to the slider 307 through the Bowden cable fixation connector 309 and the other end of the Bowden cable 109 is fixed in the left clamping opening at the end of the base plate 101 of the left foot power output assembly 1 for transmitting the pulling force from the left foot power output assembly 1 to the slider 307.

The left shank fixation plate 302 and the slider 307 are connected through the link 308 to constitute two revolute pairs and form a crank block structure, the pulling force provided to the slider 307 by the Bowden cable 209 through the tension spring 311 is converted to a counterclockwise rotation of the left shank fixation plate 302 relative to the left thigh fixation plate 301 through the link 308 to provide the left shank with a torque for assisting the bending of the left leg knee joint. The pulling force provided to the slider 307 by the Bowden cable 109 is converted to a clockwise rotation of the left shank fixation plate 302 relative to the left thigh fixation plate 301 through the link 308 to provide the left shank with a torque for assisting the stretching of the left leg knee joint. The tension spring 311 is an energy storage device and is also a buffer device. When the Bowden cable 109 provides the pulling force, the tension spring 311 converts a portion of the pulling force provided by the Bowden cable 109 into its own elastic potential energy for storage and gradually releases this portion of potential energy to the slider 307 when the pulling force provided by the Bowden cable 109 disappears in order to avoid the damage to the knee due to suddenly increased pulling force or sudden disappearance of the pulling force. Similarly, when the Bowden cable 209 provides the pulling force, the tension spring 311 converts a portion of the pulling force provided by the Bowden cable 209 into its own elastic potential energy for storage and gradually releases this portion of potential energy to the slider 307 when the pulling force provided by the Bowden cable 209 disappears in order to avoid the damage to the knee by the mechanical inertia generated due to suddenly increased pulling force or sudden disappearance of the pulling force.

Figure 6:
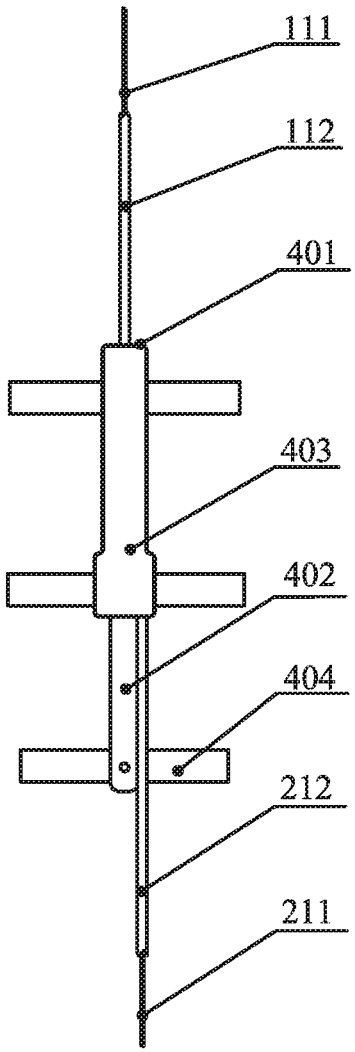
FIG. 6 is an outline diagram showing the constitution of the right leg knee joint assistance execution assembly according to the present disclosure.
Figure 7:
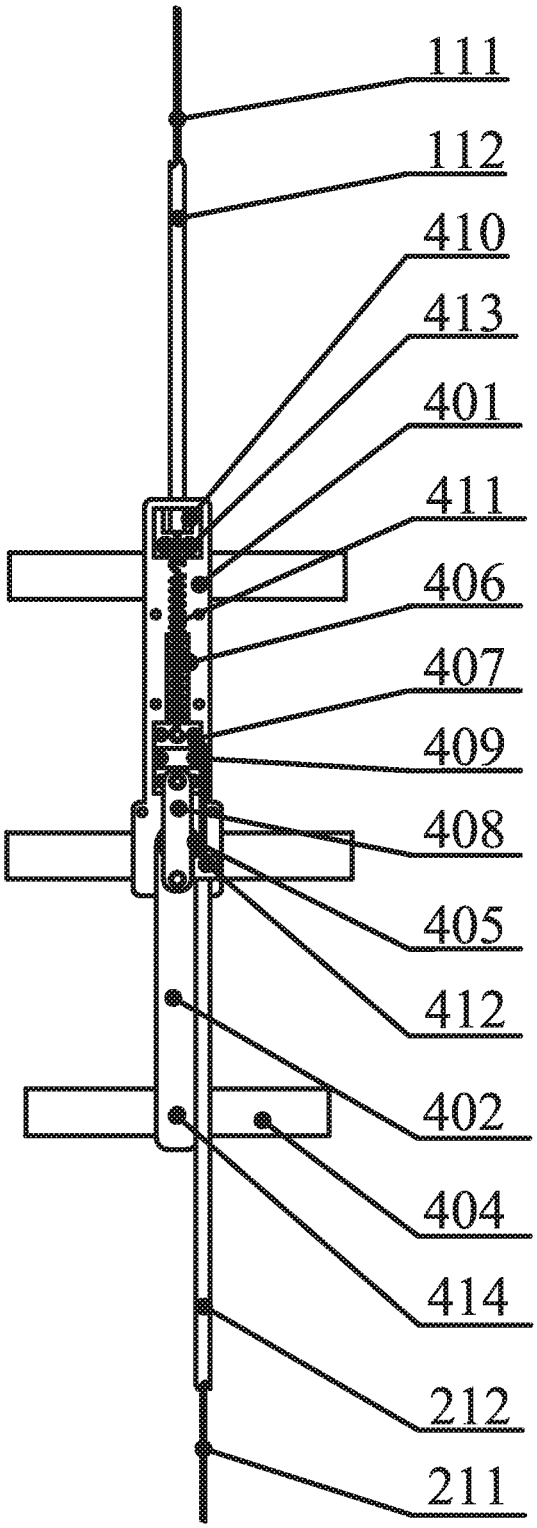
FIG. 7 is a diagram showing the main constitution and internal assembly relationship of the right leg knee joint assistance execution assembly according to the present disclosure.

FIG. 6 is an outline diagram of the right leg knee joint assistance execution assembly 4 and FIG. 7 is a diagram showing the main constitution and internal assembly relationship of the right leg knee joint assistance execution assembly 4. As shown in FIGS. 6 and 7, the right leg knee joint assistance execution assembly 4 is mainly constituted with a right thigh fixation plate 401, a right shank fixation plate 402, a protection cover 403, a flexible fixation band 404, a rotation shaft 405, a guide 406, a slider 407, a link 408, a Bowden cable fixation connector 409, a Bowden cable sleeve fixation base 410, a tension spring 411, a Bowden cable sleeve connection fixator 412, a fastener 413, a rivet 414, the Bowden cable 111, the Bowden cable sleeve 112, the Bowden cable 211 and the Bowden cable sleeve 212. The parts of the right leg knee joint assistance execution assembly 4 are the same as those at the corresponding positions of the left leg knee joint assistance execution assembly 3.

As shown in FIG. 7, the right shank fixation plate 402 is mounted on the rotation shaft 405 of the right thigh fixation plate 401 and can be rotated about the rotation shaft 405 at an angle in a design angle range. The guide 406 and the Bowden cable sleeve fixation based 410 are fixed on the right thigh fixation plate 401 through the fastener 413, and the slider 407 is mounted on the guide 406 and can do linear reciprocating motion within the rated travel of the guide. One end of the tension spring 411 is fixed to the slider 407 and the other end of the tension spring 411 is fixed to the Bowden cable 109 to be used as an energy storage unit. The Bowden cable sleeve connection fixator 412 is fixed in the mounting hole on the right side of the lower part of the right thigh fixation plate 401 through a screw fastener not only for fixing the Bowden cable sleeve 212 but also for limiting the counterclockwise rotation angle extreme position of the right shank fixation plate 402. One end of the Bowden cable 211 is fixed to the slider 407 through the Bowden cable fixation connector 409 and the other end of the Bowden cable 211 is fixed in the right clamping opening at the end of the base plate 201 of the right foot power output assembly 2 by using the passage provided by the Bowden cable sleeve 212 for transmitting the pulling force from the right foot power output assembly 2 to the slider 407.

The right shank fixation plate 402 and the slider 407 are connected through the link 408 to constitute two revolute pairs and form a crank block structure, the pulling force provided to the slider 407 by the Bowden cable 111 through the tension spring 411 is converted to a clockwise rotation of the right shank fixation plate 402 relative to the right thigh fixation plate 401 through the link 408 to provide the right shank with a torque for assisting the bending of the right leg knee joint. The pulling force provided to the slider 407 by the Bowden cable 211 is converted to a counterclockwise rotation of the right shank fixation plate 402 relative to the right thigh fixation plate 401 through the link 408 to provide the right shank with a torque for assisting the stretching of the right leg knee joint. The tension spring 411 is an energy storage device and is also a buffer device. When the Bowden cable 111 provides the pulling force, the tension spring 411 converts a portion of the pulling force provided by the Bowden cable 111 into its own elastic potential energy for storage and gradually releases this portion of potential energy to the slider 407 when the pulling force provided by the Bowden cable 111 disappears in order to avoid the damage to the knee by the mechanical inertia generated due to suddenly increased pulling force or sudden disappearance of the pulling force. Similarly, when the Bowden cable 211 provides the pulling force, the tension spring 411 converts a portion of the pulling force provided by the Bowden cable 211 to its own elastic potential energy for storage and gradually releases this portion of potential energy to the slider 407 when the pulling force provided by the Bowden cable 211 disappears in order to avoid the damage to the knee by the mechanical inertia generated due to suddenly increased pulling force or sudden disappearance of the pulling force.

The left shank fixation plate 302 can be rotated about the rotation shaft 305 relative to the left thigh fixation plate 301 at an angle in a design angle range of 120° to 180° and the right shank fixation plate 402 can be rotated about the rotation shaft 405 relative to the right thigh fixation plate 401 at an angle in a design angle range of 120° to 180°. In the design angle range of 120° to 180°, 120° is a generally required minimal angle between the shank and the thigh during the possess of stepping of a human being, i.e., the minimal angle of the knee joint when uplifting the leg, and 180° is an extreme angle formed by the knee joint when a normal person stands erect or the shank is fully stretched and strengthening. The rotation angle range of the left shank fixation plate 302 relative to the left thigh fixation plate 301 in the left leg knee joint assistance execution assembly 3 can be achieved by correspondingly adjusting the Bowden cable sleeve connection fixator 312 and the travel of the slider 307 according to actual walking gait parameter of the user, the minimal rotation angle can be 30° and the maximal rotation angle can be 200°. Similarly, the rotation angle range of the right shank fixation plate 402 relative to the right thigh fixation plate 401 in the right leg knee joint assistance execution assembly 4 can be achieved by correspondingly adjusting the Bowden cable sleeve connection fixator 412 and the travel of the slider 407 according to actual walking gait parameter of the user, the minimal rotation angle can be 30° and the maximal rotation angle can be 200°.

Figure 8:
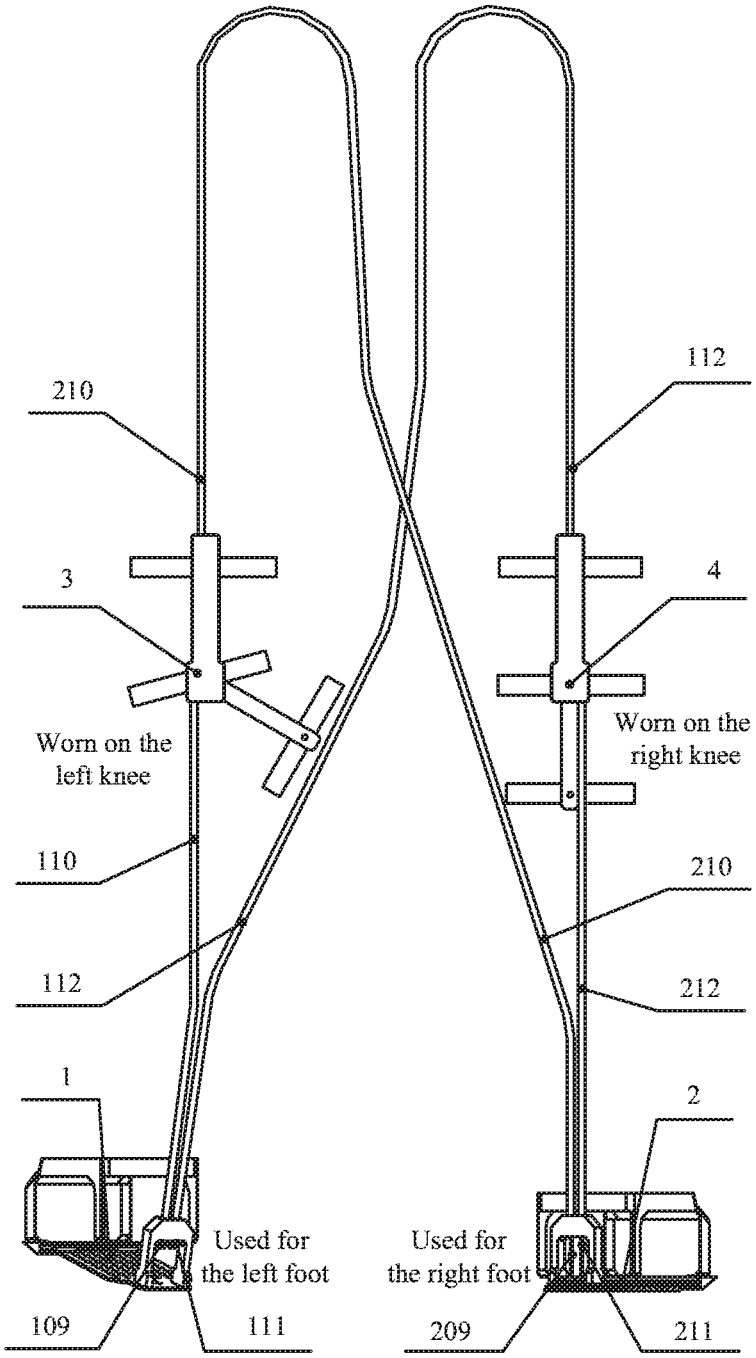
FIG. 8 is a basic operating mode diagram of the equipment according to the present disclosure.

FIG. 8 a basic operating mode diagram of the equipment according to the present disclosure. The execution assemblies of the unpowered wearable walking assistance knee equipment with gait self-adaptivity act on the knee joints of the lower extremities and use the self-weight of the human body as a driving force without the need of other external power and energy input. The equipment is based on the lever principle and crank block structure principle and adopts an operation mode of combining ipsilateral parallel driving input and different sides cross driving input performed on the left leg knee joint assistance execution assembly and the right leg knee joint assistance execution assembly by the left foot power output assembly and the right foot power output assembly. During the walking process, by utilizing the self-weight of the human body and by using Bowden cables as a medium for transmitting the driving force, the left foot power output assembly provides the left leg knee joint assistance execution assembly with a pulling force for its stretching and provides the right leg knee joint assistance execution assembly with a pulling force for its bending, and the right foot power output assembly provides the right leg knee joint assistance execution assembly with a pulling force for its stretching and provides the left leg knee joint assistance execution assembly with a pulling force for its bending, so that a torque for assisting the bending and stretching of the left leg knee joint and the right leg knee joint is generated according to a gait cycle regularity during the walking process, and the goal of walking assistance is achieved.

Specifically, as the stepping state shown in FIG. 1, the right foot touches the ground and the left foot is lifted up off the ground at this time. The base plate 201 and the active plate 202 in the right foot power output assembly 2 form the lever structure with the rotation shaft 205 as the fulcrum. The distance from the weight effect point of the self-weight of the human body on the base plate 201 to the fulcrum is the power arm of the lever, and the distance from the effect point of the joint force from the Bowden cable 209 in the left clamping opening of the base plate 201 and the Bowden cable 211 in the right clamping opening of the base plate 201 to the fulcrum is the resisting arm of the lever. The right foot power output assembly 2 is based on such lever structure and provides a pulling force to the slider 407 in the right leg knee joint assistance execution assembly 4 through the Bowden cable 211 and provides a pulling force to the tension sprig 311 in the left leg knee joint assistance execution assembly 3 through the Bowden cable 209 by using the self-weight of the human body. The pulling force provided to the slider 407 in the right leg knee joint assistance execution assembly 4 by the Bowden cable 211 is converted to a counterclockwise rotation of the right shank fixation plate 402 relative to the right thigh fixation plate 401 through the link 408 to provide the right leg knee joint with a torque for assisting its stretching during the process of stepping to assist the right leg to be fully stretched and strengthen. During this process, when the Bowden cable 211 provides the pulling force, the tension spring 411 connected with the slider 407 converts a portion of the pulling force provided by the Bowden cable 211 into its own elastic potential energy for storage and gradually releases this portion of potential energy to the slider 407 when the pulling force provided by the Bowden cable 211 disappears in order to avoid the damage to the knee by the mechanical inertia generated due to suddenly increased pulling force or sudden disappearance of the pulling force. In addition, one portion of the pulling force provided to the tension spring 311 in the left leg knee joint assistance execution assembly 3 by the Bowden cable 209 is converted into the elastic potential energy of the tension spring 311 of its own for storage and another portion of the pulling force provided by the Bowden cable 209 provides a pulling force to the slider 307 through the tension spring 311 and is converted to a counterclockwise rotation of the left shank fixation plate 302 relative to the left thigh fixation plate 301 through the link 308 to provide the left leg knee joint with a torque for assisting its bending to assist the left leg to step forward. The tension spring 311 gradually releases its own stored elastic potential energy to the slider 307 when the pulling force provided by the Bowden cable 109 disappears to avoid the damage to the knee due to suddenly increased pulling force or sudden disappearance of the pulling force.

Subsequently, the left foot gradually touches the ground and the right foot starts to be lifted up off the ground, and the self-weight of the human body gradually focus on the left foot. The power torque formed by the self-wright of the human body on the base plate 101 provides a pulling force to the Bowden cable 109 in left clamping opening at the end of the base plate 101 and the Bowden cable 111 in the right clamping opening at the end of the base plate 101 based on the lever structure formed by the base plate 101 and the active plate 102 in the left foot power output assembly 1 with the rotation shaft 105 as the fulcrum. The Bowden cable 109 directly provides a pulling force to the slider 307 in the left leg knee joint assistance execution assembly 3 and the Bowden cable 111 provides a pulling force to the tension spring 411 in the right leg knee joint assistance execution assembly 4. The pulling force provided to the slider 307 by the Bowden cable 109 is converted to a clockwise rotation of the left shank fixation plate 302 relative to the left thigh fixation plate 301 through the link 308 to provide the left leg knee joint with a torque for assisting its stretching to assist the left leg to be fully stretched and strengthen. During this process, when the Bowden cable 109 provides the pulling force, the tension spring 311 connected with the slider 307 converts a portion of the pulling force provided by the Bowden cable 109 into its own elastic potential energy for storage and gradually releases this portion of potential energy to the slider 307 when the pulling force provided by the Bowden cable 109 disappears in order to avoid the damage to the knee by the mechanical inertia generated due to suddenly increased pulling force or sudden disappearance of the pulling force. In addition, one portion of the pulling force provided to the tension spring 411 in the right leg knee joint assistance execution assembly 4 by the Bowden cable 111 is converted to the elastic potential energy of the tension spring 411 of its own for storage and another portion of the pulling force provided by the Bowden cable 111 provides a pulling force to the slider 407 through the tension spring 411 and is converted to a clockwise rotation of the right shank fixation plate 402 relative to the right thigh fixation plate 401 through the link 408 to provide the right leg knee joint with a torque for assisting its bending to assist the right leg to step forward, and then to start a next stepping cycle. The tension spring 411 gradually releases its own stored elastic potential energy to the slider 407 when the pulling force provided by the Bowden cable 111 disappears to avoid the damage to the knee due to suddenly increased pulling force or sudden disappearance of the pulling force.

The above is the mechanism of the unpowered wearable walking assistance knee equipment with gait self-adaptivity in one stepping cycle of a human being. The present disclosure not only has the function of assisting the population with decreased motor ability in lower extremity, the population with sports injuries in lower extremity joints and the patients with partial disability in lower extremity to walk, but also can help the population with decreased motor ability in lower extremity and the patients with partial disability in lower extremity to improve their muscle vitality so as to improve their self-care abilities and health status.

The above embodiments are only preferred embodiments of the present disclosure and any general variations and substitution for the embodiments made by those skilled in the art within the scope of the technical solutions of the present disclosure shall fall into the protection scope of the present disclosure.

The invention claimed is:

1. An unpowered wearable walking assistance knee equipment with gait self-adaptivity, comprising:

a left leg knee joint assistance execution assembly adapted to be fixed at a position corresponding to the left leg knee joint for providing the left leg knee joint with a torque for assisting its stretching and bending during a walking process;

a right leg knee joint assistance execution assembly adapted to be fixed at a position corresponding to the right leg knee joint for providing the right leg knee joint with a torque for assisting its stretching and bending during the walking process;

a left foot power output assembly adapted to be worn on a user's left foot and capable of providing the left leg knee joint assistance execution assembly with a power for its stretching and providing the right leg knee joint assistance execution assembly with a power for its bending;

a right foot power output assembly adapted to be worn on a user's right foot and capable of providing the right leg knee joint assistance execution assembly with a power for its stretching and providing the left leg knee joint assistance execution assembly with a power for its bending; and a driving force transmission device capable of transmitting the power provided by the left foot power output assembly and the right foot power output assembly to the left leg knee joint assistance execution assembly and the right leg knee joint assistance execution assembly;

wherein the left foot power output assembly comprises: a first base plate, a first active plate, a first Bowden cable sleeve fixation bracket, a first hinge and a first rotation shaft; a front end of the first base plate and a front end of the first active plate form a lever structure with the first rotation shaft as a fulcrum; a rear end of the first base plate is connected with one end of the first Bowden cable and one end of the second Bowden cable, and a rear end of the first active plate is connected with one end of the first Bowden cable sleeve and one end of the second Bowden cable sleeve; and wherein the right foot power output assembly comprises: a second base plate, a second active plate, a second Bowden cable sleeve fixation bracket, a second hinge and a second rotation shaft; a front end of the second base plate and a front end of the second active plate form a lever structure with the second rotation shaft as a fulcrum; a rear end of the second base plate is connected with one end of the third Bowden cable and one end of the fourth Bowden cable and a rear end of the second active plate is connected with one end of the third Bowden cable sleeve and one end of the fourth Bowden cable sleeve.

2. The unpowered wearable walking assistance knee equipment of claim 1, wherein the driving force transmission device comprises:

a first Bowden cable and a first Bowden cable sleeve, one end of which being connected with the left foot power output assembly and the other end of which being connected with a stretching power input of the left leg knee joint assistance execution assembly for enabling the left foot power output assembly to provide the left leg knee joint assistance execution assembly with a pulling force for its stretching;

a second Bowden cable and a second Bowden cable sleeve, one end of which being connected with the left foot power output assembly and the other end of which being connected with a bending power input of the right leg knee joint assistance execution assembly for enabling the left foot power output assembly to provide the right leg knee joint assistance execution assembly with a pulling force for its bending;

a third Bowden cable and a third Bowden cable sleeve, one end of which being connected with the right foot power output assembly and the other end of which being connected with a bending power input of the left leg knee joint assistance execution assembly for enabling the right foot power output assembly to provide the left leg knee joint assistance execution assembly with a pulling force for its bending; and a fourth Bowden cable and a fourth Bowden cable sleeve, one end of which being connected with the right foot power output assembly and the other end of which being connected with a stretching power input of the right leg knee joint assistance execution assembly for enabling the right foot power output assembly to provide the right leg knee joint assistance execution assembly with a pulling force for its stretching.

3. The unpowered wearable walking assistance knee equipment of claim 1, wherein the left foot power output assembly and the right foot power output assembly each also comprises: a rubber pad, a rubber buffer fiction pad, a rubber anti-slip pad and an elastic fixation band.

4. The unpowered wearable walking assistance knee equipment of claim 1, wherein the first base plate and the second base plate are made of hard aluminum alloy material, and the first active plate and the second active plate are made of carbon fiber material.

5. The unpowered wearable walking assistance knee equipment of claim 1, wherein the left leg knee joint assistance execution assembly comprises: a left thigh fixation plate, a left shank fixation plate, a first guide, a first slider, a first link and a first tension spring; the left thigh fixation plate, the left shank fixation plate, the first link, the first guide and the first slider constitute a crank block structure and form two revolute pairs; the first Bowden cable is configured to provide a pulling force to the first slider that is converted to a clockwise rotation of the left shank fixation plate relative to the left thigh fixation plate through the first link to provide the left shank with a torque for assisting the stretching of the left leg knee joint; the third Bowden cable is configured to provide a pulling force to the first slider through the first tension spring and the pulling force is converted to a counterclockwise rotation of the left shank fixation plate relative to the left thigh fixation plate through the first link to provide the left shank with a torque for assisting the bending of the left leg knee joint; and the right leg knee joint assistance execution assembly comprises: a right thigh fixation plate, a right shank fixation plate, a second guide, a second slider, a second link and a second tension spring; the right thigh fixation plate, the right shank fixation plate, the second link, the second guide and the second slider constitutes a crank block structure and form two revolute pairs; the second Bowden cable is configured to provide a pulling force to the second slider that is converted to a clockwise rotation of the right shank fixation plate relative to the right thigh fixation plate through the second link to provide the right shank with a torque for assisting the bending of the right leg knee joint; the fourth Bowden cable provides a pulling force to the second slider through the second tension spring and the pulling force is converted to a counterclockwise rotation of the right shank fixation plate relative to the right thigh fixation plate through the second link to provide the right shank with a torque for assisting the stretching of the right leg knee joint.

6. The unpowered wearable walking assistance knee equipment of claim 5, wherein the left leg knee joint assistance execution assembly and the right leg knee joint assistance execution assembly each also comprises a protection cover and a flexible fixation band.

7. The unpowered wearable walking assistance knee equipment of claim 5, wherein the left shank fixation plate is configured to be rotated relative to the left thigh fixation plate at an angle in a range of 30° to 200° in the left leg knee joint assistance assembly and the right shank fixation plate can be rotated relative to the right thigh fixation plate at an angle in a range of 30° to 200° in the right leg knee joint assistance assembly.

8. The unpowered wearable walking assistance knee equipment of claim 7, wherein the left shank fixation plate is configured to be rotated relative to the left thigh fixation plate at an angle in a range of 120° to 180° in the left leg knee joint assistance assembly and the right shank fixation plate can be rotated relative to the right thigh fixation plate at an angle in a range of 120° to 180° in the right leg knee joint assistance assembly.

9. The unpowered wearable walking assistance knee equipment of claim 5, wherein the left thigh fixation plate, the left shank fixation plate, the right thigh fixation plate and the right shank fixation plate are made of high carbon fiber material, aluminum-magnesium alloy or hard aluminum alloy material.

* * * * *